US006230752B1

(12) United States Patent
Dornier et al.

(10) Patent No.: US 6,230,752 B1
(45) Date of Patent: May 15, 2001

(54) METHOD AND APPARATUS FOR RAPIDLY EXCHANGING A SHED DRIVE IN A HEALD LOOM

(75) Inventors: Peter D. Dornier, Nonnenhorn; Valentin Krumm, Hergensweiler, both of (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/580,283

(22) Filed: May 30, 2000

(30) Foreign Application Priority Data

May 28, 1999 (DE) ..... 199 24 434

(51) Int. Cl.[7] ..... D03J 1/00; D03D 49/00
(52) U.S. Cl. ..... 139/1 R; 242/533.8; 414/401
(58) Field of Search ..... 139/1 R; 242/533.8; 414/401

(56) References Cited

U.S. PATENT DOCUMENTS 2,579,730 * 12/1951 Eurey ..... 139/1 R
5,261,463 * 11/1993 Sato ..... 319/1 R
5,394,596 * 3/1995 Lidenmuller et al. ..... 28/208
5,826,624 * 10/1998 Graser ..... 139/1 R
6,056,022 * 5/2000 Graser ..... 139/1 R

FOREIGN PATENT DOCUMENTS 1394014 5/1975 (GB) .

* cited by examiner

*Primary Examiner*—Andy Falik
(74) *Attorney, Agent, or Firm*—W. F. Fasse; W. G. Fasse

(57) ABSTRACT

The shed formed by the warp threads in a loom is changeable by a shed drive that may either be an eccentric drive or a shaft drive. In order to rapidly exchange one shed drive (2) by another shed drive (3) these shed drives are mounted individually in a respective carriage (4). The carriage is constructed for docking in an exchange position next to the loom. An empty first carriage can take up a shed drive currently cooperating with the loom to remove the shed drive from the loom. A second carriage carrying another shed drive can then dock in the exchange position after the second carriage has been removed. The carriage is positionable either manually or automatically in response to distance signals.

18 Claims, 4 Drawing Sheets

METHOD AND APPARATUS FOR RAPIDLY EXCHANGING A SHED DRIVE IN A HEALD LOOM

PRIORITY CLAIM

This application is based on and claims the priority under 35 U.S.C. §119 of German Patent Application 199 24 434.0, filed on May 28, 1999, the entire disclosure of which is incorporated herein by reference.

FIELD OF THE INVENTION

The invention relates to a method and apparatus for rapidly exchanging a shed drive in a heald or dobby loom. The shed drive can be an eccenter drive or a shaft drive for changing the shed in the loom. Technical weaving conditions determine which type of shed changing drive is used.

BACKGROUND INFORMATION

Jet weaving looms, particularly air jet weaving looms using air jets for the weft insertion, are capable of operating with an r.p.m. of the main drive shaft in excess of 1000 r.p.m. compared to gripper looms in which so-called rapiers are used for the weft insertion into the shed.

It is known to connect high speed heald or dobby looms, referred to herein as the loom or looms, to eccentric drives for the formation or changing of the shed formed by the warp threads. Slower working looms, namely looms with a mechanical weft insertion instead of an air jet weft insertion are connected to so-called shaft drives for the shed formation or shed change. The reasons for using either an eccentric drive or a shaft drive for the shed formation depend, among others, on the type of fabric or article to be produced on the loom. The eccentric shed formation drive and the shaft shed formation drive will be referred to herein simply as shed drives.

For example, if it is necessary to exchange an eccentric shed drive on a loom by a shaft shed drive, such an exchange requires a substantial effort and expense, particularly in man hours for the time consuming disassembly or disconnection of the currently used shed drive from the loom followed by an even more time consuming installation of the other shed drive. The installation of a new shed drive is time consuming because positioning and adjusting operations must be performed so that the new shed drive may be precisely coupled to the loom.

OBJECTS OF THE INVENTION

In view of the above it is the aim of the invention to achieve the following objects singly or in combination:

- to provide a method for rapidly exchanging one type of shed drive against another type of shed drive in a loom, particularly by avoiding or minimizing time consuming adjustment operations;
- to substantially increase the versatility of heald looms, particularly to increase the number of bindings that can be woven on the loom and with regard to minimizing specific rejects of the woven fabrics;
- to couple that type of shed drive with the loom which will optimize the loom capability for any particular use; and
- to provide a carriage which efficiently permits performing the present method of exchanging one type of shed drive against another in a loom while simultaneously reducing the number of heretofore required man-hours for such an exchange.

According to the invention there is provided a method for rapidly exchanging a first shed drive by a second shed drive in a loom. Performance of the method requires an empty shed drive transport carriage and a carriage with a shed drive mounted in the carriage. The empty first transport carriage is first brought into a precise exchange position relative to the loom, which carries the first shed drive. Then the first shed drive is connected to the first transport carriage whereby the first shed drive is held in the first transport carriage. Next, the first shed drive is decoupled from its drive connection in the loom. Now, the first transport carriage holding the first shed drive is moved out of the precise exchange position and the second transport carriage with the exchange shed drive mounted therein is moved into the precise exchange position. Next, connector elements of the second shed drive are aligned with connector members of the loom. Last, the connector elements of the shed drive are coupled with the connector members of the loom for securing the second shed drive in the loom. Decoupling the carriage from the shed drive that is now mounted in the loom and removing the carriage from the loom are optional at this time.

According to the invention each type of shed drive is mounted in a precise position on a carriage that can be guided and docked next to the loom in a precise shed drive exchange position. The guided docking can be performed manually or motor driven in response to automatic controls. Guide elements and stops are provided on the loom and/or on the carriage so that the carriage is in a precisely defined shed drive exchange position relative to the loom when the docking operation is completed. As a result, the connections of the shed drive to the loom may be performed rapidly and time consuming precision adjustments are avoided.

A substantially automatic docking is performed in response to control signals generated by spacing or distance sensors producing signals that are processed in a central processing unit which in turn controls suitable motor drives or spindle drives in response to the distance signals. The distance or spacer sensors determine the distances between the carriage and the loom relative to the coordinates of an x, y and z three-dimensional coordinate system. The distance sensors may either be connected to the loom or to the carriage and reflectors may be connected to the carriage or the loom respectively, whereby the spacing or distance signals are provided in a contactless manner to the central processing unit for the operation of the drive motors or spindle drives that position the carriage by steering its power driven wheels and/or the shed drive on the carriage. Infrared transmitters and receivers are suitable for the present distance measuring purposes.

The spacings between the reference points on the shed drive and the sensors arranged on the loom are continuously measured during the docking and positioning of the shed drive relative to the loom. Currently measured values are compared with previously measured values and the respective differences of the distances are compared with each other or with predetermined reference or rated values provided in a memory of the central processing unit. The result of the comparing is converted into control signals for operating the drive motors that position the carriage and the respective shed drive. Thus, the wheels of the carriage are preferably power driven and the positioning may be accomplished by spindle drives or the like. The positioning drives may be directly operated or they may be operated through a remote control by an operator.

In the preferred embodiment of the invention one shed drive is an eccenter drive and the other shed drive is a shaft drive constructed particularly with regard to their connector elements to be exchangeable.

According to the invention there is also provided a carriage constructed for docking next to a heddle loom. The carriage is constructed to support one or the other of the shed drives, whereby the position adjustment drives such as spindle drives or rack and pinion drives or piston cylinder drives within the carriage precisely position the coupling or connector elements of the shed drive with the coupling or connector members of the loom.

The adjustment elements are manually operable mechanical drives, for example such as the above mentioned spindle drives or hydraulic or pneumatic drives or drives operated by an electrical motor. Thus, for example a spindle drive may be operated by an electric motor in response to a remote control by an operator who reads a display that provides the distance and directional information. The sensors and reflectors for the distance measuring devices can be arranged on the loom and on the carriage and/or on the shed drive, preferably the reflecting reference points are provided on the carriage and/or on the shed drive while the sensors such as an infrared transmitter and receiver or an ultrasonic transmitter and receiver are positioned at defined points of the loom. In any event, the outputs of the sensors are supplied to the control processing unit to provide the control signals for the respective drives.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
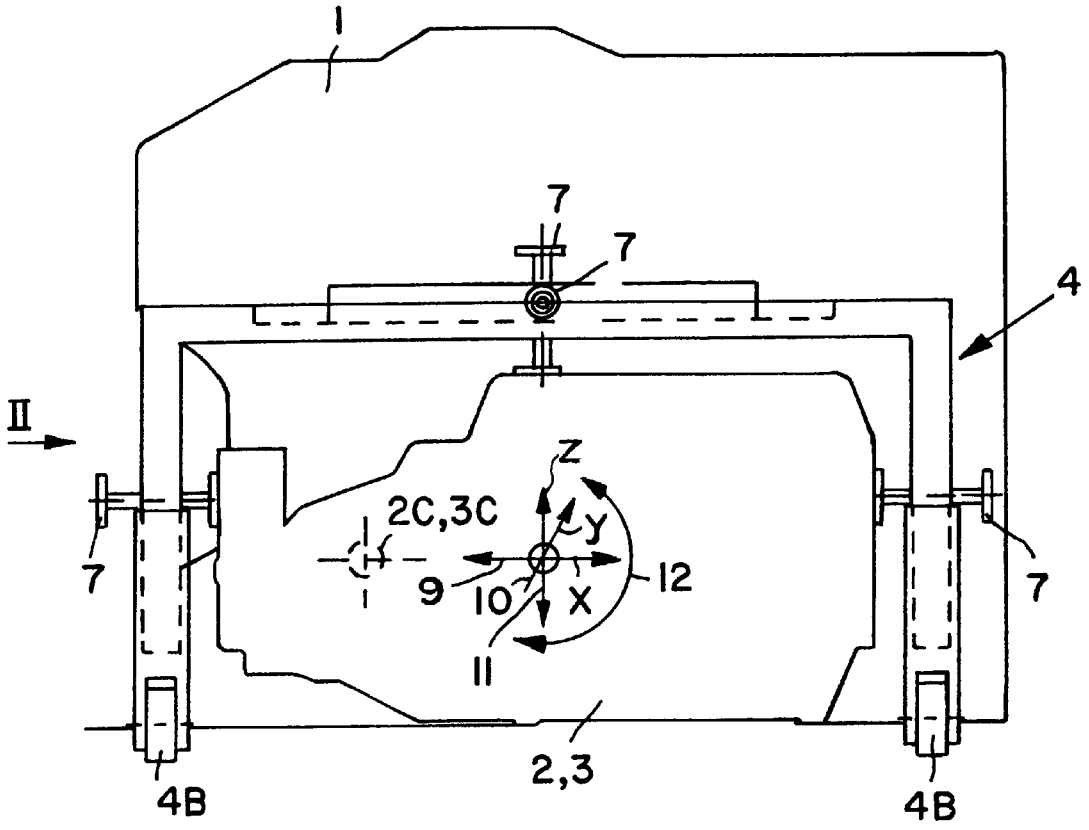
FIG. 1 illustrates a front view of a carriage in which a shed drive is mounted for positioning relative to a loom such as a heald loom.
Figure 2:
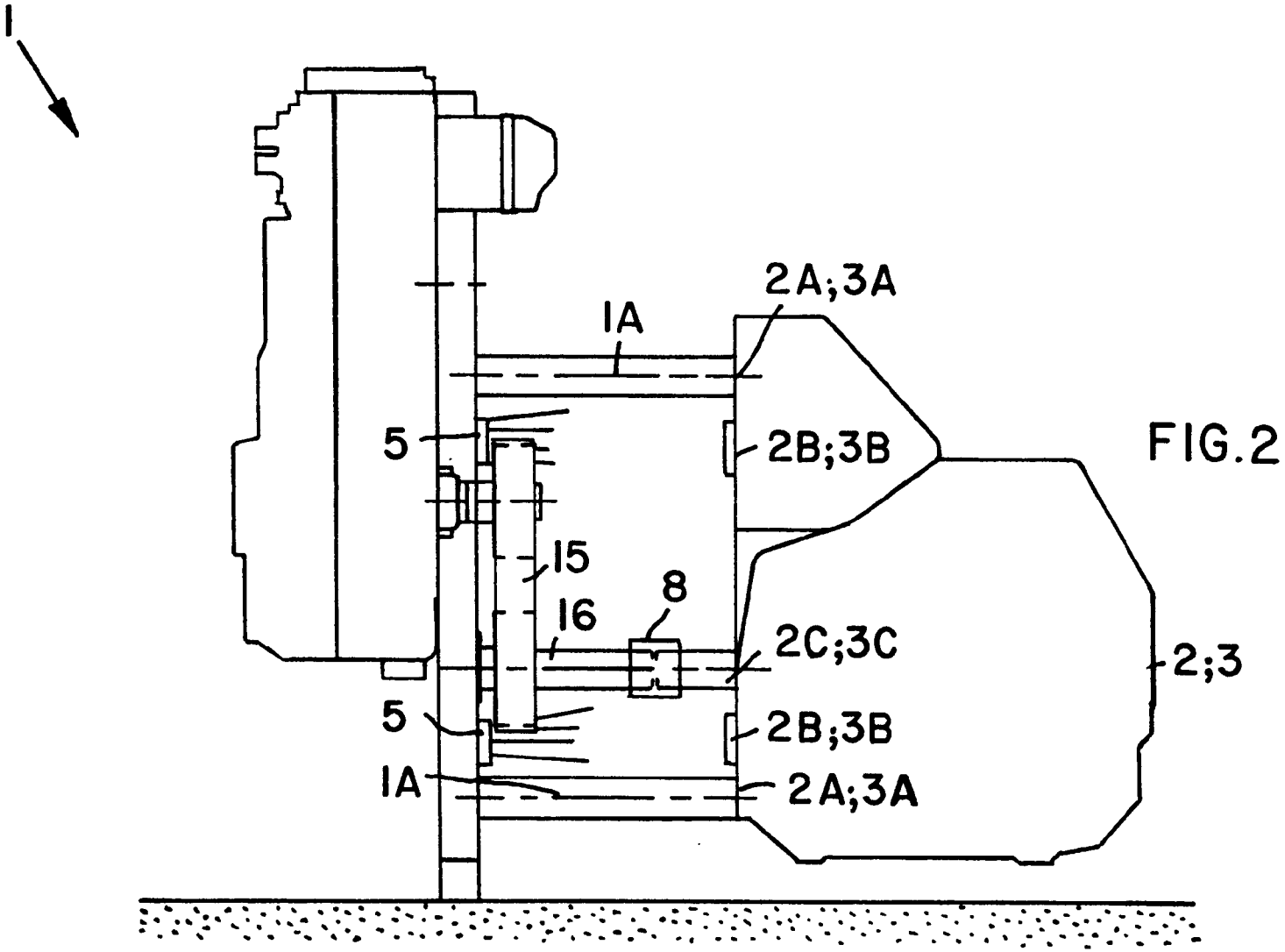
FIG. 2 is a view in the direction of the arrow II in FIG. 1 illustrating the shed drive connected or coupled to the heald loom with the carriage removed.

FIGS. 1 and 2 show in conjunction and schematically a loom 1 connected to a shed drive 2 or 3. Shed drive 2 is intended to be an eccentric shed drive while shed drive 3 is intended to be a shaft shed drive. Both are merely shown schematically. The shed drive is mounted in a carriage 4 provided with wheels 4*b* which may be power driven and are controllable for positioning to roll in any direction. Positioning and mounting elements 7 connect the shed drive 2 or 3 to the carriage 4 in a precisely defined position. These positioning or mounting elements are adjustable either manually by respective hand wheels or by a power drive 6 to be described below. With the help of the mounting and positioning elements 7, the shed drive 2 or 3 can be positioned relative to a three-dimensional coordinate system x, y and z, wherein the x-direction is shown by an arrow 9, the y-direction is shown by an arrow 10, and the z-direction is shown by an arrow 11. An angular adjustment of the shed drive 2 or 3 about the y-direction 10 or y-axis is indicated by the double arrow 12.

A power output shaft or drive shaft 2*c*, 3*c* of the shed drive must be so positioned that coupling with a power input shaft 16 of the heald loom 1 is easily accomplished, for example by a drive-coupling such as a clutch 8 or the like. Further, connector elements 2*a*, 3*a* of the shed drive are so positioned that coupling with frame components 1*a* of the loom frame of the heald loom 1 is possible. The arrangement is such that the coupling of the power output shaft 2*c*, 3*c* of the shed drive with the power input shaft 16 of the loom 1 is readily accomplished by simple means, preferably a quick coupling device, e.g. the clutch 8. Similarly, the connection between sockets 2*a*, 3*a* of the shed drive with the frame members 1*a* of the loom, are also readily and quickly accomplished, for example by threaded connections or clamping connections.

FIG. 2 further shows symbolically distance measuring elements 5 such as infrared transmitter receivers so positioned on the loom frame that cooperation with reflectors 2*b*, 3*b* on the shed drive is readily accomplished for the proper alignment of the shed drive relative to the loom in a shed drive exchange position. While the sensors 5 are shown to be attached to the loom frame, they could alternatively be attached to the shed drive. In that case, the reflectors 2*b*, 3*b* would be attached to the loom frame. However, the positioning shown in FIG. 2 is preferred since the outputs of the sensors 5 are more easily connected to a central processing unit 13 shown in FIG. 4, if the sensors are stationary with loom 1 rather than movable with the Carriage 4.

Figure 3:
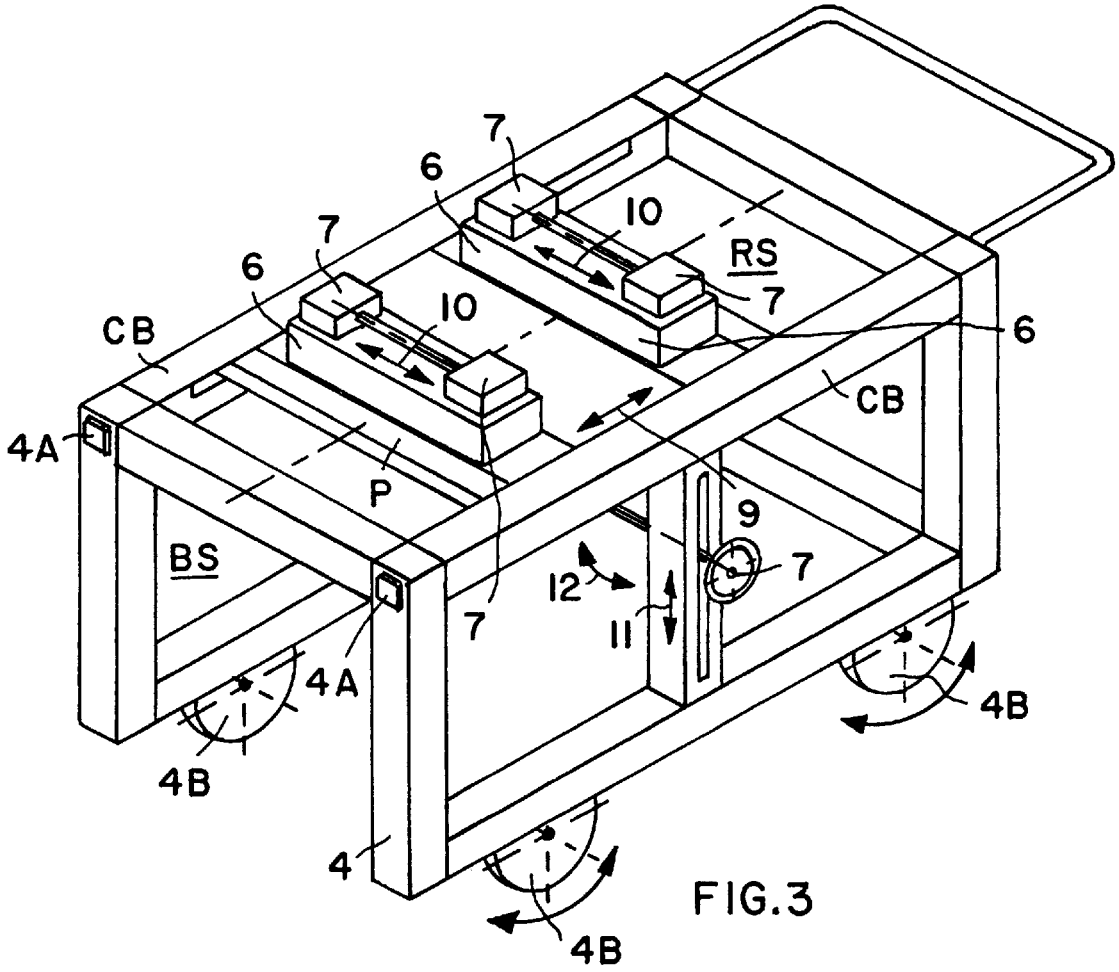
FIG. 3 is a perspective view of the present carriage for transporting a shed drive into and out of an exchange position for cooperation with a loom.

FIG. 3 shows the carriage 4 in the form of an open frame provided with the above mentioned steerable wheels 4*b* which are adjustable to move the frame 4 in the desired direction and may be driven by a power drive. The wheels 4*b* are also lockable once the carriage is in the proper exchange position. The above mentioned reflectors 4*a* are strategically positioned at such points that cooperation with the transmitter receiver or sensor 5 of the loom 1 is assured. An operator may read the distance information on a display 14 controlled by the central processing unit 13 for properly positioning the carriage 4 relative to the loom 1 in the exchange position. Conventional wheel locking devices are preferably used to lock the carriage 4 in an aligned exchange position.

Figure 4:
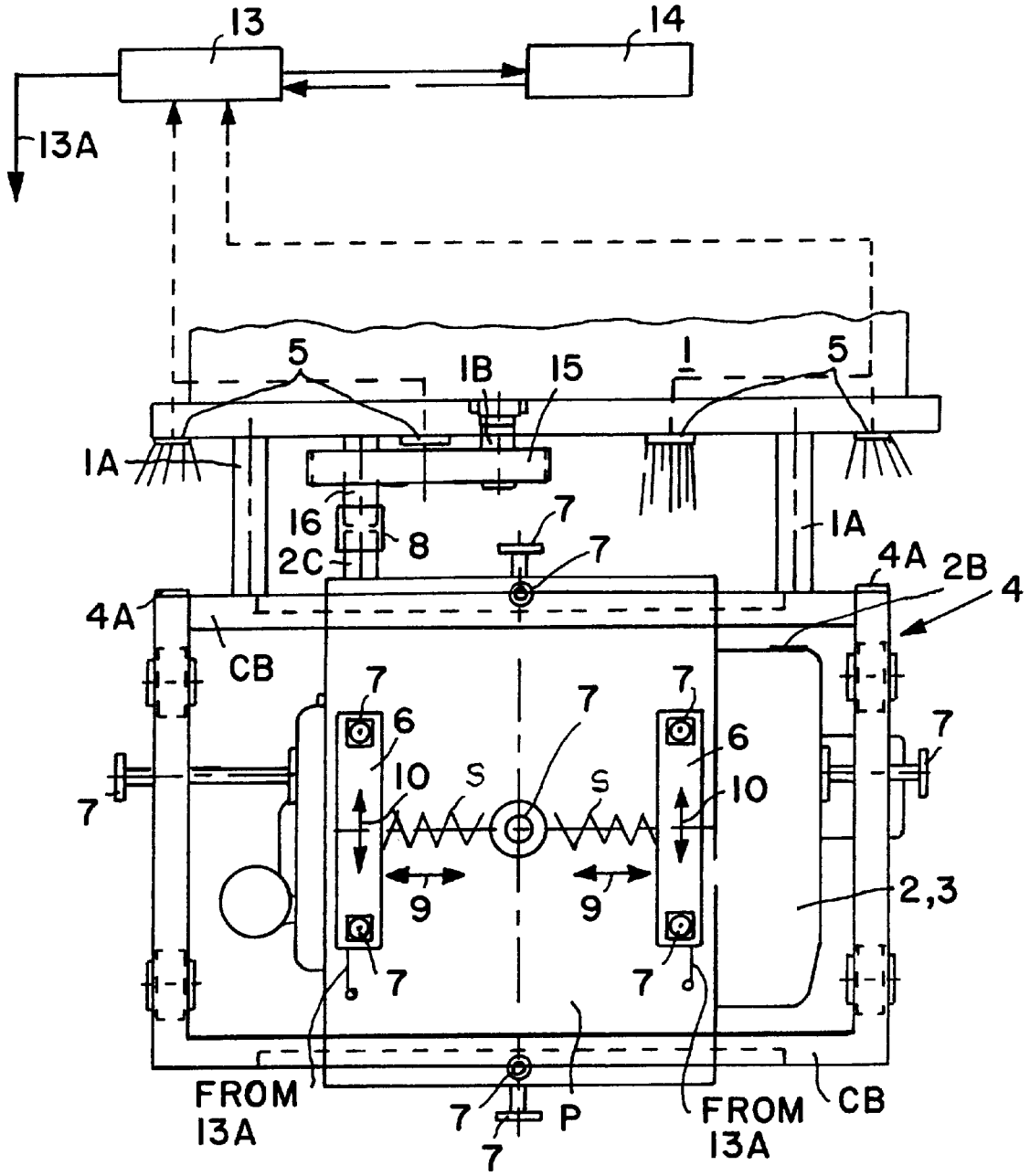
FIG. 4 is a schematic top plan view illustrating the distance measuring components for positioning the carriage relative to a heddle loom.

FIG. 4 shows the carriage 4 precisely positioned and locked in the exchange position relative to the loom 1 in which the connector shafts 1*a* are properly aligned with the respective connector positions on the carriage 4 and the power output shaft 2*c* is properly aligned with the power input shaft 16. As mentioned, the drives 7 may for example be spindles either manually operated or driven by electric spindle motors 6.

As shown, several distance measuring devices or sensors 5 are provided for cooperation with respective reflectors 4*a* on the carriage 4 and 2*b* on the shaft drive. Distances measured on the left side are preferably compared with distances on the right side. When the distances are equal, the carriage is positioned in parallel to the loom 1. An output 13*a* provides a control signal for the drives 6. Another output of the central processing unit 13 is connected to the display 14 which also may include a keyboard for providing information to the central processing unit 13 by the operator.

Referring further to FIG. 4, the carriage 4 has a platform P that supports at least some of the mounting members 7 and drives 6. The platform P is movable in the directions of the arrows 9 along the top crossbars CB of the carriage 4. Each drive 6 is also movable in the direction of the respective arrow 9 preferably against the force of a respective biasing spring S to assure a precise positioning in the x-direction (arrow 9). FIGS. 3 and 4 further show the adjustability of certain of the mounting members 7 in the y-direction (arrow 10) and of other mounting members in the z-direction (arrow 11).

As shown in FIG. 3 the carriage 4 is open at its back side BS and at its rear side RS to permit removal of the shed drive from the carriage 4. A corner post between the back side BS and the rear side RS may be omitted for this purpose as seen in FIG. 3.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for rapidly exchanging a first shed drive by a second shed drive in a loom, comprising the following steps:

(a) first guiding and docking an empty first transport carriage (4) into a precise shed drive exchange position relative to said loom (1), (b) connecting said first shed drive (2) to said first transport carriage so that said first shed drive is held in a precise position on said first transport carriage, (c) decoupling said first shed drive from its drive connection in said loom, (d) moving said first transport carriage with said first shed drive held in said precise position in said first transport carriage out of said precise shed drive exchange position, (e) second guiding and docking a second transport carriage having mounted therein in a precise position, said second shed drive (3), into said precise shed drive exchange position, (f) aligning connector elements of said second shed drive with connector members of said loom, and (g) coupling said connector elements with said connector members of said loom for securing said second shed drive in said loom.

2. The method of claim 1, further comprising:

(a1) decoupling said second shed drive which is now mounted in said loom from said second transport carriage, and (b1) removing said second now empty transport carriage from said loom.

3. The method of claim 1, comprising manually performing said first and second guiding and said docking steps a) and e) and manually performing said aligning step (f).

4. The method of claim 1, further comprising sensing with a sensor (5) relative positions between said loom and said shed drive on any one of said first and second transport carriages to provide sensor output signals for generating control signals in response to said sensor output signals, and controlling a motorized positioning of said first and second carriages relative to said loom in response to said control signals.

5. The method of claim 4, further comprising providing at least one reference point (4*a*, 2*b*) for positioning said shed drive (2 or 3) in said loom, measuring with said sensor (5) a distance between said sensor (5) and said at least one reference point (4*a*, 2*b*) to provide distance signals as said sensor output signals, comparing said distance signals with a reference signal to provide a comparator output signal, and generating said control signals based on said comparator output signal for said controlling of said motorized guiding and docking.

6. The method of claim 5, further comprising generating said reference signal based on previously measured distance values.

7. The method of claim 5, further comprising generating said reference signal as a rated reference value and storing said rated reference value in a memory of a central processing and control unit (13).

8. The method of claim 1, further comprising sensing with a sensor (5) relative positions between said loom and said shed drive on any one of said first and second transport carriages to provide sensor output signals, converting said sensor output signals into distance signals representing distances between said loom and said shed drive, and using said distance signals for positioning any one of said first and second carriages into said precise shed drive exchange position.

9. The method of claim 1, further comprising using as said first shed drive an eccenter shed drive and as said second shed drive a shaft shed drive.

10. A system for rapidly exchanging one shed drive (2) for another shed drive (3) in a loom, said system comprising a first shed drive (2) and a second shed drive (3), a first shed drive transport carriage and a second shed drive transport carriage, each shed drive transport carriage comprising a carriage frame (4), position controllable wheels (4*b*) supporting each of said first and second shed drive transport carriages, mounting members (7) for securing said first or second shed drive (2 or 3) in a defined position in said first or second shed drive transport carriage (4), and positioning means (6) for adjusting said first or second shed drive relative to said loom (1), said first and second shed drives comprising connector elements (2*a*, 3*a*; 2C, 3C) adapted for matching respective connector members (1*a*, 15, 16) of said loom (1) for securing said first or second shed drive in said loom.

11. The system of claim 10, wherein said mounting members (7) comprise adjustable mechanical drives for positioning said first or second shed drive in said first or second shed drive transport carriage in said defined position within a three-dimensional coordinate system.

12. The system of claim 11, further comprising at least one power drive (6) for driving at least one of said adjustable mechanical drives.

13. The system of claim 10, comprising at least one open side for removing said shed drive out of said shed drive transport carriage and for moving said shed drive transport carriage away from said loom.

14. A system for rapidly exchanging a first shed drive (2) by a second shed drive (3) in a loom, said system comprising a loom (1), at least one shed drive transport carriage comprising a carriage frame (4), at least one first distance and position measuring component (5) secured in a first defined position, controllable wheels (4*b*) supporting said shed drive transport carriage, mounting members (7) for securing said first or second shed drive (2 or 3) in said carriage frame, and first positioning means for docking said carriage relative to said loom and second positioning means for adjusting said first or said second shed drive to said loom so that coupling elements (2*a*, 3*a*; 2*c*, 3*c*) of said first or second shed drive match respective coupling members (1*a*, 15, 16) of said loom (1), at least one second distance and position measuring component (4*a*; 2*b*; 3*b*) secured in a second defined position for cooperation with said at least one distance measuring component (5) in said first defined position for generating distance signals representing a distance between said loom and said shed drive transport carriage, said distance signals further representing a position between said loom and said first or second shed drive, and a central electronic processing unit (13) connected to receive said distance signals and said position signals for processing and for providing docking control signals for said shed drive transport carriage and for processing and providing adjusting control signals for said first or second shed drives.

15. The system of claim 14, wherein said at least one first distance and position measuring component comprises a radiation source and a sensor (5) having an output connected to said electronic processing unit (13), and wherein said second distance and position measuring component is a reflector (4*a*; 2*b*; 3*b*) positioned for reflecting radiation received from said radiation source.

16. The system of claim 15, wherein said radiation source and sensor (5) are secured to said loom, and wherein said reflector (4*a*; 2*b*; 3*b*) is secured to one of said shed drive transport carriage and said shed drive.

17. The system of claim 15, wherein said radiation source and said sensor (5) are secured to one of said shed drive transport carriage and said shed drive, and wherein said reflector is secured to said loom.

18. The system of claim 14, further comprising a display (14) connected to said electronic processing unit (13) for displaying distance and position information for facilitating docking of said carriage and for facilitating adjusting of said first or second shed drive relative to said loom.

* * * * *